US005242006A

United States Patent [19]

Ortega

[11] Patent Number: 5,242,006

[45] Date of Patent: Sep. 7, 1993

[54] DRAPERY WEIGHT AND METHOD

[76] Inventor: Eudelio Ortega, 6250 W. 6th Ave., Hialeah, Fla. 33012

[21] Appl. No.: 960,735

[22] Filed: Oct. 14, 1992

[51] Int. Cl.[5] ..... A47H 5/00

[52] U.S. Cl. ..... 160/344; 160/320; 16/219

[58] Field of Search ..... 160/320, 344, 340; 16/216, 217, 218, 219

[56] References Cited

U.S. PATENT DOCUMENTS

| | | | |
|---|---|---|---|
| 1,309,670 | 7/1919 | Weiss | 16/219 |
| 4,366,852 | 1/1983 | Holzer | 160/320 |
| 4,411,044 | 10/1983 | Volfson | 16/219 |
| 4,909,298 | 3/1990 | Langhart et al. | 160/320 X |

FOREIGN PATENT DOCUMENTS

| | | | |
|---|---|---|---|
| 708804 | 5/1965 | Canada | 160/320 |
| 2604911 | 11/1977 | Fed. Rep. of Germany | 16/219 |

*Primary Examiner*—Blair M. Johnson
*Attorney, Agent, or Firm*—Jack E. Dominik

[57] ABSTRACT

A drapery weight in which a body portion and cover are snap fittingly engaged each to the other is disclosed. An open space is provided interiorly to receive whatever weights the factory or installer preselects for the given installation. Thereafter, provision is made for a wheel or circular member at the upper inner portion of the body around which the installer can readily engage the closed loop of the draw cord because the body is not totally closed. Finally, a snap-fittingly engaged cover is placed over the wheel or round portion and mates with one of the body sections to close the drapery weight as a unitary member. Snap fitting engagement is provided between the two body shells, and the cover for the rounded member, in the form of a plurality of interacting prongs between the two body shells, and a displaceable engagement for the wheel cover. Optionally a wheel is mounted on the central hub. Otherwise the hub itself is sufficient to hang the weight on the closed loop of the drapery draw cord. The method is directed to providing the installer with a weight, and the installer opening and closing the upper portion to thereby string the closed loop of the drapery cord.

6 Claims, 4 Drawing Sheets 26
12
31
25
26
32
19
40
35
14
41
36
25
15
18
28
22
24
30
11
24
28
22
16
20
39
38

DRAPERY WEIGHT AND METHOD

FIELD OF THE INVENTION

The present invention is directed to a drapery weight, and more particularly that type which receives a closed loop of a draw cord, which cord is reciprocated to open or close a drape. A weight receives the closed loop at its upper end portion and gravitationally holds it in a low position so that the person moving the drapes can grasp the cords and by moving them one way or the other which opens or closes the drape.

SUMMARY OF THE PRIOR ART

Drapery weights have essentially replaced the spring-loaded wheel through which the drapes' draw cord is passed. Such spring-loaded units had to be screwed to the wall, window frame, door frame, and the like. There was always the risk of inadvertent dislodgement by pulling the cord too hard. Moreover, the complexities of the tension loaded wheel rendered the unit inherently expensive to manufacture. Subsequently a drapery weight was developed in which an elongate body normally enclosed a metallic weight of some sort, and a curved structure is at the upper end to receive the closed loop end portion of the drapery draw cords. The big problems with these units include, primarily, ease of insertion of the drapery draw cord onto the wheel or post around which the cord should pass. In addition, entry into the loop portion in many instances had to be a threaded approach such as threading a needle with a single strand and therefore would require stringing the strand through the drapery mount or carrier and not the simple approach of engaging a closed loop.

SUMMARY OF THE INVENTION

The present invention relates to a drapery weight in which a body portion and cover are snap fittingly engaged each to the other. An open space is provided interiorly to receive whatever weights the factory or installer preselects for the given installation. Thereafter, provision is made for a wheel or circular member at the upper inner portion of the body around which the installer can readily engage the closed loop of the draw cord because the body is not totally closed. Finally, a snap-fittingly engaged cover is placed over the wheel or round portion and mates with one of the body sections to close the drapery weight as a unitary member. Snap fitting engagement is provided between the two body shells, and the cover for the rounded member, in the form of a plurality of interacting prongs between the two body shells, and a displaceable engagement for the wheel cover. Optionally a wheel is mounted on the central hub. Otherwise the hub itself is sufficient to hang the weight on the closed loop of the drapery draw cord. The method is directed to providing the installer with a weight, and the installer opening and closing the upper portion to thereby string the closed loop of the drapery cord.

In view of the foregoing it is a principal object of the present invention to provide a drapery weight which permits the installer to preselect the amount and kind of weights to be employed, and in addition renders positioning the same on a closed loop of a drapery draw cord very easy and simple and yet the same can be closed to appear and function as a single unit.

Another object of the present invention is to provide a drapery weight which gives the installer the option of a rotating wheel or engaging the closed loop with a hub which lightly frictionally permits moving the drapery cords.

Yet another and most important advantage of the present invention is to achieve the above objectives with a construction which is inherently competitive for manufacturing purposes with the prior art, and yet provide superior advantages in installation and usage.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
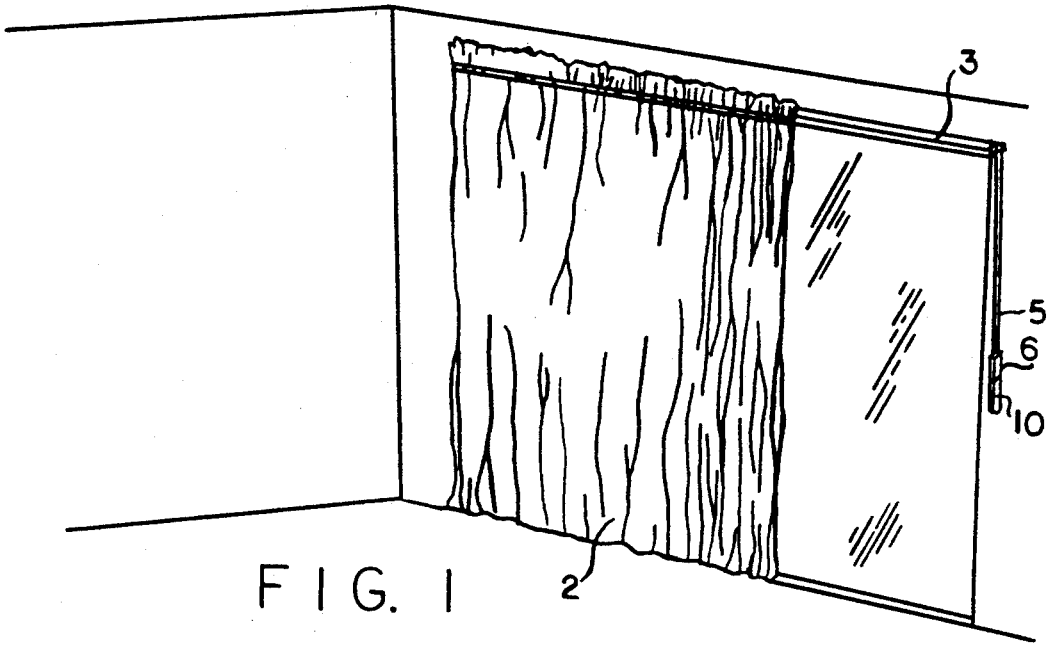
FIG. 1 is a front view of a typical drapery installation on a sliding glass door leading to a patio showing specifically where the drapery weight may be located and its relationship to the draw cord and the drapery itself.

The environment of the subject invention is illustrated diagrammatically in FIG. 1 where it will be seen that the corner of a room is shown with a typical sliding glass door. Covering the sliding glass door is a drape 2 which is supported by a drapery hanger 3. A cord loop 5 for moving the drapery 2 back and forth on the drapery hanger 3 terminates in a closed loop which is secured by the drapery weight 10.

Figure 2:
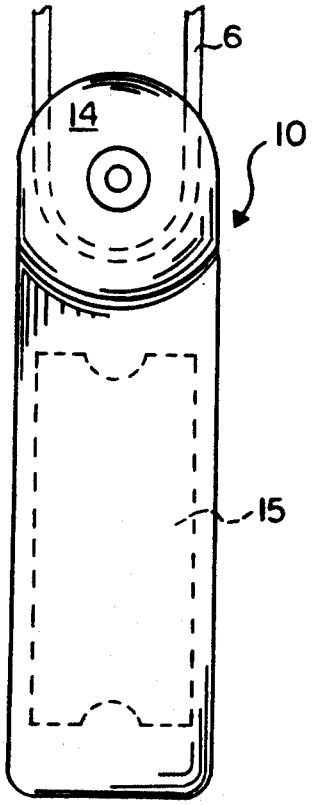
FIG. 2 is a front elevation of the preferred embodiment showing the weight in phantom lines interiorly.
Figure 3:
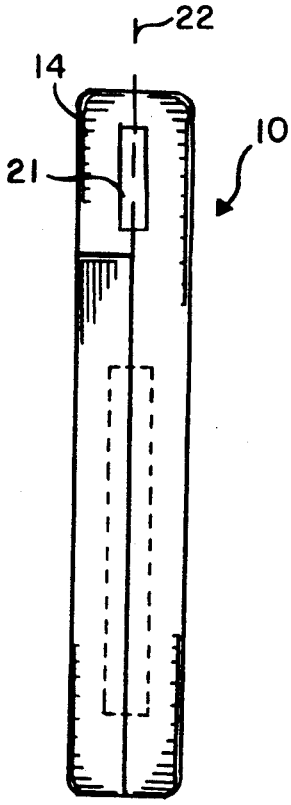
FIG. 3 is a side view of the drapery weight showing the cord slot.
Figure 4:
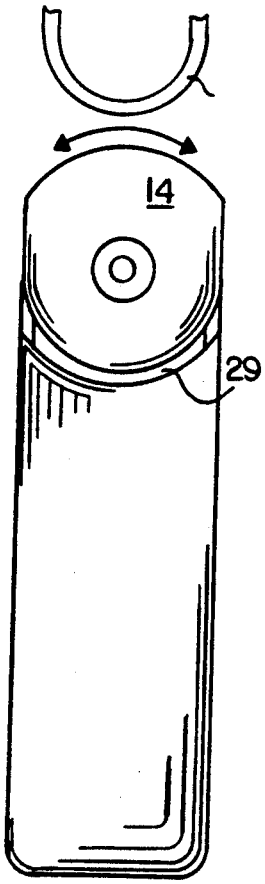
FIG. 4 is an alternative view to FIG. 2 showing the closer rotated to provide an opening for inserting the drapery cord.

The drapery weight 10 as shown in FIG. 2 in front elevation contains an interiorly positioned weight 15. As shown in one side view, FIG. 3, a closer cord slot 21 is provided in the upper portion of the drapery weight and on each side thereof. Finally, as shown in FIG. 4, when the closer 14 is rotated, a cord insert slot 29 is exposed which permits the installer to install the cord 5 in the slot, rotate the closer 14, and close the same to the configuration as shown in FIG. 2, completing the installation of FIG. 1.

Figures 5, 6, 7, 8, 9:
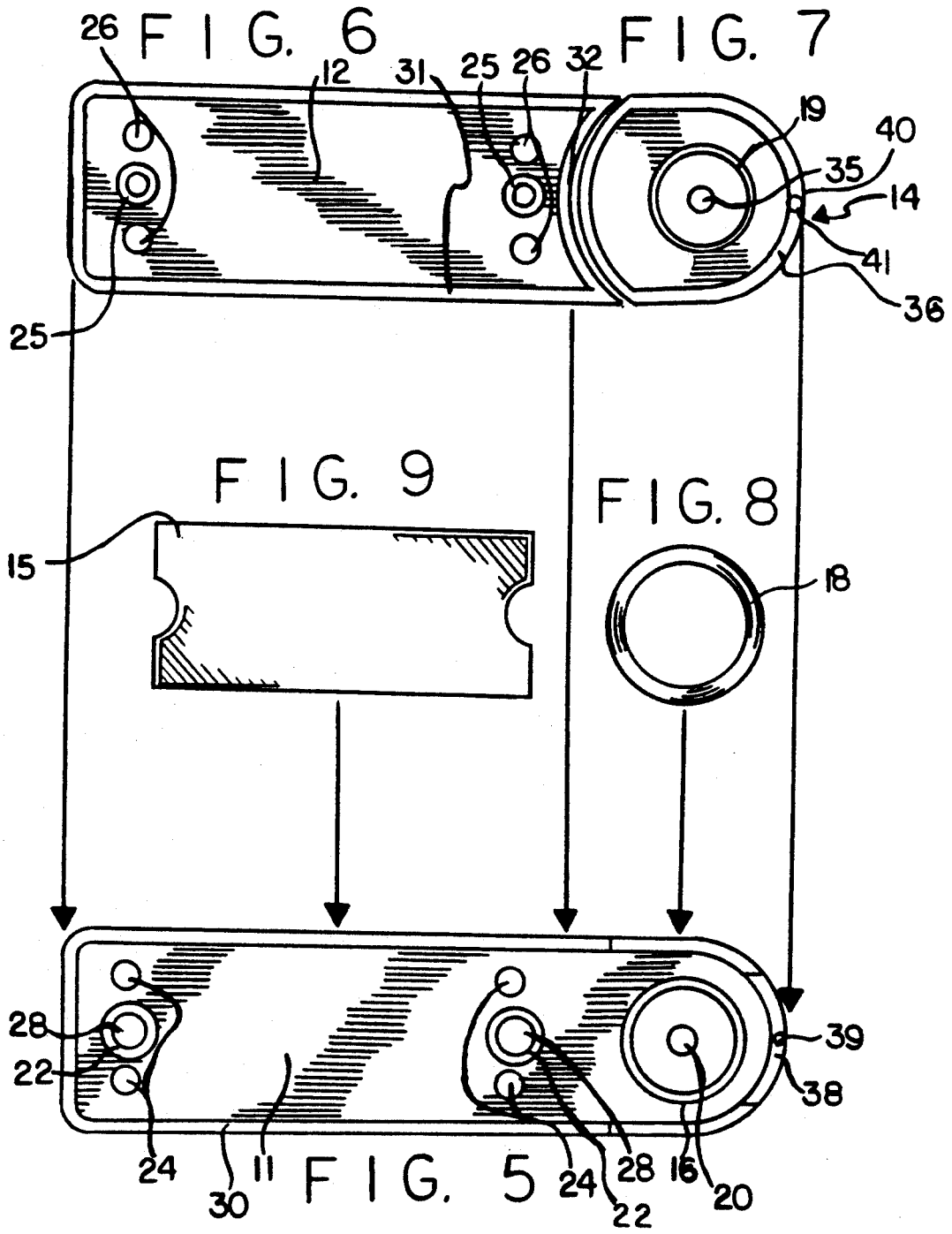
FIG. 5 is a plan view of the drapery weight body interior.
FIG. 6 is a plan view of the drapery weight cover interior.
FIG. 7 is an interior view of the drapery weight closer in plan elevation.
FIG. 8 is an end view of the wheel which is positioned inside the drapery weight body.
FIG. 9 is a plan view of the weight which is positioned interiorly of the body and thereafter covered by the cover.

In more specific detail, it will be noted that the drapery weight 10 includes the drapery weight body 11 shown in FIG. 5. In FIG. 6, the drapery weight cover 12 is disclosed. It is intended to be applied over the body 11 after the weight 15 has been inserted into the body 11. The closer 14, as shown by way of distinction between open and closed position in FIGS. 2 and 4, has an arcuate radius at one end and an arcuate radius at the other end, the radii are drawn on spaced centers. Thus, when the closer 14 is rotated 180° the cord insert slot 29 is exposed in one direction, but after rotation the cord is closed as noted in FIG. 2. In the closed configuration, the only access to the cord is through the closer cord slots 21. Thereafter, the hub 16 of the body 11 receives the wheel 18, and the closer 14 is applied over the same either before or after the cover 12 is applied over the body 11. The net result is that the drapery weight 10 is made up, after closing the same, and as shown particularly in FIGS. 2, 3, and 4 of a body 11, a cover 12, a closer 14, a weight 15, and a wheel 18 which is applied over the hub 16 in the body 11. The closer lock 20 is in the form of an upstanding pin extending upwardly from planar portion of the weight body 11. The closer 14 has a central closer lock mount 35 in the form of an aperture in the closer 14. When the closer 14 is applied atop the body 11, the upper end of the closer lock pin 20 is swedged, heat deformed, or otherwise permanently deformed at its upper end to preclude the subsequent removal of the closer 14 from the weight body 11. Thus, when the lock pin 20 is swedged, there are no loose parts to the entire drapery weight 10. The only feature that can be changed is to go from the cord closed configuration of FIG. 2 to the cord replacement configuration of FIG. 4.

Turning now to FIG. 5, in greater detail it will be seen that circular collars form a pair of cover mounts 22 extending upwardly from the plane of the body 11. Weight pins 24 flank the cover mounts 22 and assist in securing the weight 15 in a sandwiched relationship to cover weight pins 26 when the cover mount pins 25 are press fitted into the cups 28 of the cover mounts 22. The tolerance between the pins 25 and cups 28 are determined to insure a tight press fit.

The body 11, as shown in FIG. 5, has a base wall 30. Similarly, a cover wall 31 is provided to surround the base of the weight cover 12 and the perpendicular with its main portion. A closer crescent 32 is provided at one end of the cover which assists in defining the drapery weight cord slot 29 as shown in FIG. 4.

Finally, it will be seen that a closer lock mount 35 as just described in connection with FIG. 7 coacts with a crescent-shaped wall 36 on the closer for opening and closing the same. The retaining arc 38 on the cover 14 completes the structure of the closer 14 with the exception of the removable securing elements. The removable securing elements include the retaining arc 38 as shown on the body 11 in FIG. 5, and an upstanding retaining pin 39. These coact with the closer arc portion foot 40 and the closer detent 41 which snap actingly engages the retaining pin 39 to permit opening and closing the closer 4 from the configurations shown in FIG. 2 and FIG. 4.

ALTERNATIVE EMBODIMENTS

The alternative embodiments shown sequentially in FIGS. 10–15 will be described only insofar as they differ what appears in the preferred embodiment described in connection with FIGS. 1–9.

Figure 10:
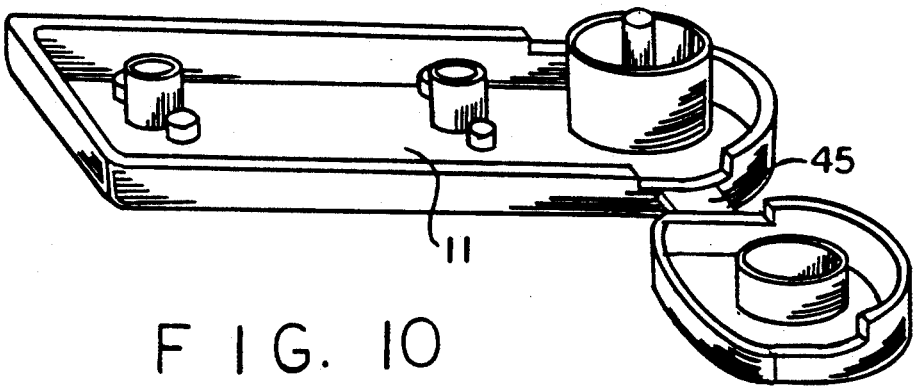
FIG. 10 shows a first alternative embodiment with a living hinge for rotating the cover from one side of the body.
Figure 11:
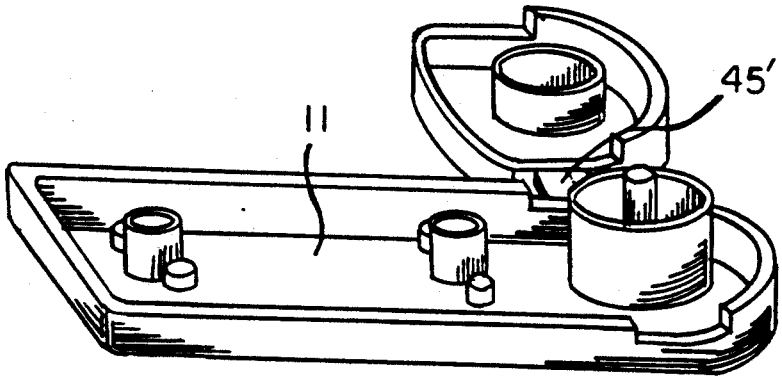
FIG. 11 is a further perspective view of an alternative embodiment utilizing a living hinge to rotate the cover from the other side as that shown in FIG. 10.
Figure 12:
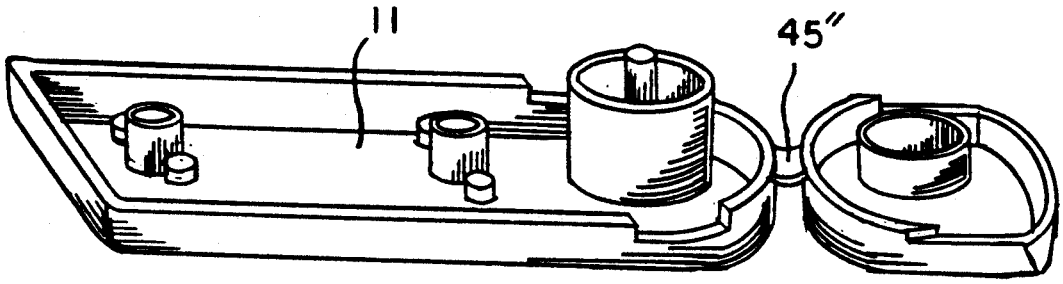
FIG. 12 is yet a further alternative embodiment showing a living hinge at the upper portion of the body and cover.

The alternative embodiment of FIG. 10 utilizes a living hinge 45 mounted on one side of the base of the weight body 11. The alternative embodiment of FIG. 11 utilizes a living hinge 45′ on the opposite side of the weight body 11. Finally, in FIG. 12 the living hinge 45″ is employed at the upper curved portion of the weight body 11.

Figure 13:
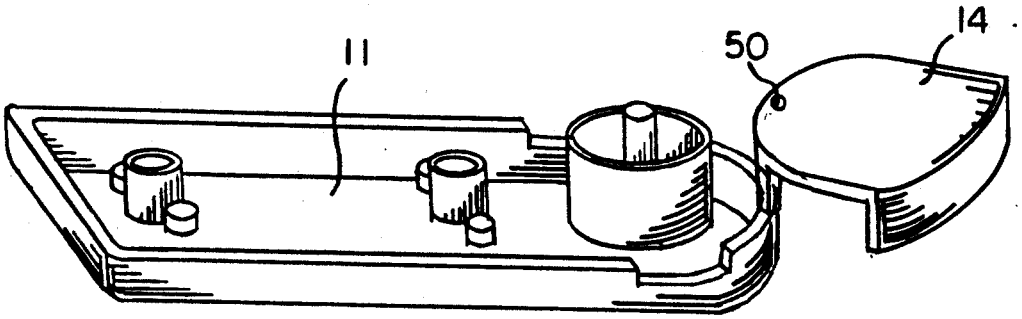
FIG. 13 is yet another alternative embodiment shown for pivoting the cover at the upper end of the body of the drapery weight.

In FIG. 13, the closer 14 is secured by means of a pivot pin 50 at the retaining arc portion 38 of the weight body 11.

Figure 14:
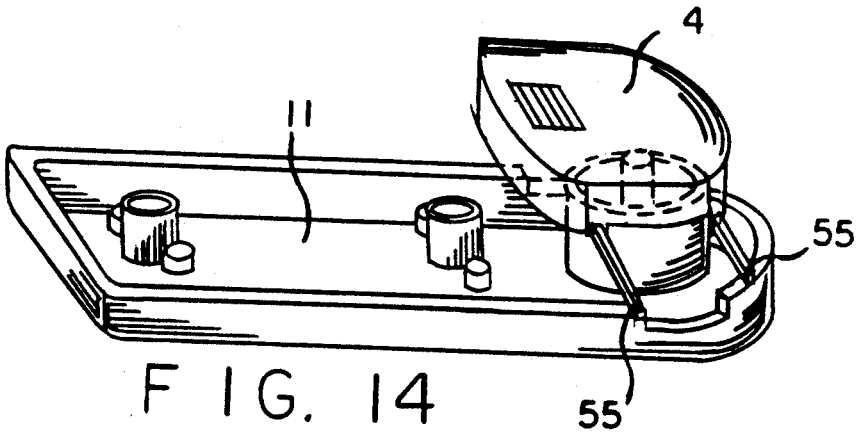
FIG. 14 is yet another embodiment showing laterally shifting the drapery weight slot cover into position.
Figure 15:
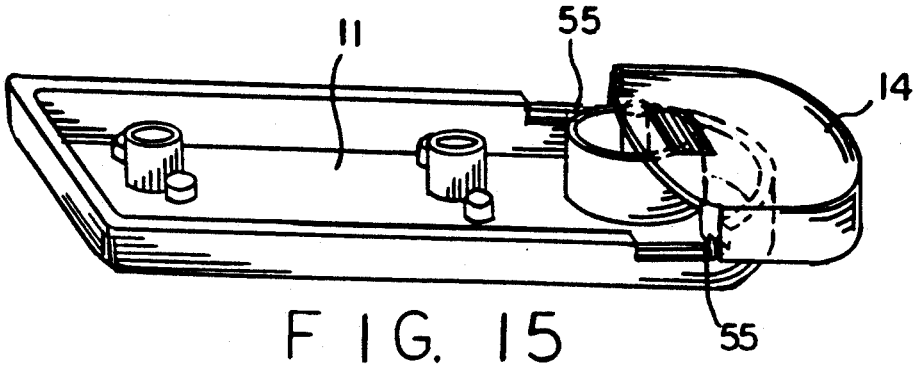
FIG. 15 is yet another alternative embodiment showing longitudinally moving the draper weight cover into position.

As shown in FIG. 14, the closer 14, is modified in its underneath portions to snap-actingly engage a pair of parallel rails 55. In the embodiment shown in FIG. 15, the parallel rails 55′ are provided in the slot forming portion on the base wall 30 of the weight body 11 to secure the closer 14′.

THE METHOD

The method of the present invention is directed to forming a drapery weight 10 in such a manner that in one configuration it has a closer 14 which provides an insert slot 29 to secure the closed end of a drapery cord 5 interiorly of the drapery weight 10. The installer then secures the drapery cord 5 in relationship to the drapery hanger 3 in accordance with state of the art practice, making sure that the closed in loop 6 of the drapery cord 5 is in a position where the drapery weight 10 will be convenient to grasp by the user. The closer is then opened to present a crescent-shaped slot into which the drapery closed end 6 is inserted. Thereafter, the closer is shifted to cover the slot, and the installation of the weight is completed.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. A drapery weight for a draw cord comprising, in combination, a main body comprising first and second body portions, said first body portion comprising the entire periphery of one side of the drapery weight, said second body portion terminating at an end exposing an upper interior portion of the first body portion, said first body portion having a molded hub extending from said upper interior portion, said hub having means for engaging an opposed retainer, means defining a cord half circular track interiorly of the first body portion, and a rotatable cover secured to the hub for covering the same and rotatable to expose an insert slot, whereby a closed end cord may be inserted in an upper end of the main body and preselected weight may be snap fitted into the main body whereupon the cover is closed by the installer and the drapery weight is in position without having to thread the closed loop draw string through the same.

2. In the drapery weight of claim 1, each body portion have a recess to receive a weight between the two body portions and sandwiched therebetween.

3. A drapery weight for a draw cord comprising, in combination, a main body comprising first and second body portions having means proportioned for press fit engagement, each with the other, said first body portion comprising the exterior of one side of the drapery weight, the said second body portion terminating at an end exposing an upper interior portion of the first body portion, said first body portion having a molded hub extending from upper interior portion, said hub having means for engaging an opposed retainer, means having opposed cord slots leading into a upper interior of the main body, and a rotatable cover secured to the hub for covering the same and rotatable to expose an insert slot, whereby a closed end cord may be inserted in an upper end of the main body and preselected weights may be snap fitted into the main body whereupon the cover is closed by the installer and the drapery weights is in position without having to thread the closed loop draw string through the same.

4. In the drapery weight of claim 3, each body portion having a recess to receive a weight between the two body portions and sandwiched therebetween.

5. A method of applying a drapery weight to the closed end of a drapery code in which said drapery weight has a hollow body, a secured closer centrally rotatably mounted on a hub on an interior portion of said hollow body, an insert slot conforming to a closed loop on a drapery cord, and a weight positioned interiorly of the body, comprising the steps of:

installing a drapery cord on a drapery hanger, said cord having a closed loop positioned at a location convenient for manipulating by a person wishing to manipulate the drapery, opening the closer on the drapery weight by rotation thereof, closing the closer on the drapery weight by rotation thereof after the closed end loop is inserted in the weight, whereby the weight is installed and can be removed at its intended permanent location in relationship to the drape being manipulated.

6. A drapery weight for a draw cord comprising, in combination, a main body comprising first and second body portions having means proportioned for press fit engagement, each with the other, said first body portion comprising the exterior of one side of the drapery weight, said second body portion terminating at an upper end exposing an upper interior portion of the first body portion, said first body portion having a molded hub extending from an upper end portion, said hub having means for engaging an opposed container, means having opposed cord slots leading into the upper interior of the main body, and a cover having opposed arcuate ends of different radii of curvature and central means located between said opposed arcuate ends for rotatable permanent securement to the upper end of the second body portion, whereby a closed end cord may be inserted in an upper end of the main body and preselected weight may be snap fitted into the main body whereupon the cover is closed by the installer and the drapery weights is in position without having to thread the closed loop draw string through the same.

* * * * *